US007045745B2

(12) United States Patent
Kim

(10) Patent No.: US 7,045,745 B2
(45) Date of Patent: May 16, 2006

(54) HEATING COOKER HAVING A STEAM GENERATING UNIT

(75) Inventor: Sung Kwang Kim, Ansan-Si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 10/853,228

(22) Filed: May 26, 2004

(65) Prior Publication Data

US 2005/0139588 A1 Jun. 30, 2005

(30) Foreign Application Priority Data

Dec. 30, 2003 (KR) ..... 10-2003-0099946

(51) Int. Cl.
*A21B 1/22* (2006.01)

(52) U.S. Cl. ..... 219/400; 219/401; 219/403; 392/394; 392/397; 392/398; 126/369; 126/348; 99/467; 99/473

(58) Field of Classification Search ..... 219/400, 219/401, 403; 392/394, 397, 398, 401, 402; 126/369, 369.1, 369.2, 348; 99/467, 468, 99/473, 474

See application file for complete search history.

(56) References Cited

U.S. PATENT DOCUMENTS

| | | | | |
|---|---|---|---|---|
| 4,281,636 | A * | 8/1981 | Vegh et al. | 126/369 |
| 4,449,026 | A | 5/1984 | Satoh | |
| 5,158,064 | A * | 10/1992 | Willis et al. | 126/20 |
| 5,515,773 | A * | 5/1996 | Bullard | 99/330 |
| 6,350,965 | B1 * | 2/2002 | Fukushima et al. | 219/401 |

FOREIGN PATENT DOCUMENTS

| | | |
|---|---|---|
| JP | 56-162328 | 12/1981 |
| JP | 04-012390 | 1/1992 |
| JP | 05-156455 | 10/1993 |
| JP | 08-178298 | 7/1996 |
| JP | 09-004849 | 1/1997 |
| JP | 2001-355844 | 12/2001 |

* cited by examiner

*Primary Examiner*—Shawntina Fuqua
(74) *Attorney, Agent, or Firm*—Sughrue Mion, PLLC

(57) ABSTRACT

A heating cooker, capable of supplying steam into a cooking chamber thereof, includes a cabinet defined therein with a cooking chamber, and a steam generating unit for supplying steam into the cooking chamber. The steam generating unit includes a heating tank detachably mounted to the top of the cooking chamber inside the cooking chamber, and provided with steam outlet ports, a water tank detachably mounted to the cabinet over the cooking chamber, and connected to the heating tank via a guide passage to supply water into the heating tank, and a steam generating heater installed in the heating tank to heat water contained in the heating tank.

18 Claims, 5 Drawing Sheets

HEATING COOKER HAVING A STEAM GENERATING UNIT

CROSS-REFERENCE TO RELATED APPLICATION

This application claims the priority of Korean Patent Application No. 2003-99946, filed on Dec. 30, 2003 in the Korean Intellectual Property Office, the disclosure of which is incorporated herein in its entirety by reference.

BACKGROUND OF THE INVENTION

1. Field of the Invention

An apparatus consistent with the present invention relates to a heating cooker and, more particularly, to a heating cooker equipped with a steam generating unit capable of supplying steam into a cooking chamber.

2. Description of the Related Art

As a heating cooker typically including a cooking chamber for receiving food to be cooked, and heating means for heating the food received in the cooking chamber, there are a microwave oven, an electric oven, and a gas oven.

In the microwave oven, microwaves generated from a magnetron are supplied into a cooking chamber so that food received in the cooking chamber is cooked by heat emitted therefrom by virtue of the microwaves applied thereto. In the electric oven or gas oven, heat generated in accordance with the operation of an electric heater or combustion of gas is applied to the interior of a cooking chamber defined in the oven, so that food received in the cooking chamber is cooked.

In such heating cookers, there is a drawback in that food being cooked may be excessively dried out because its moisture evaporates during the cooking process. In order to solve such a problem, active research has been made in the associated industrial field to provide a heating cooker equipped with a steam generating unit for supplying steam into a cooking chamber of the heating cooker, thereby being capable of preventing food, which is being cooked, from being dried while achieving an improvement in cooking effect. In an example of such a heating cooker, a water reservoir is provided at the bottom of a cooking chamber within the cooking chamber, and a heater is installed in the water reservoir. In this case, steam is generated as water contained in the water reservoir is heated by the heater.

However, this heating cooker has various problems. For example, it is inconvenient to use since the user must fill the water reservoir with water every time the heating cooker is to be used. Furthermore, there is a problem in terms of sanitary conditions because food solids or oil may be introduced into the water reservoir in the cooking process.

In addition, since the heater of the steam generating unit is maintained in a state of being dipped in water contained in the water reservoir, foreign matter may be attached to the inner surface of the water reservoir and the surface of the heater. For this reason, although the user has to perform a cleaning operation for periodically removing such foreign matter, it is impossible to simply perform the cleaning operation because it is difficult to separate the water reservoir and heater from the cooking chamber.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

An apparatus consistent with the present invention has been made in view of the above mentioned problems, and one aspect of the invention provides a heating cooker configured to simply achieve cleaning and sanitary management for a steam generating unit equipped therein.

Another object of the invention is to provide a heating cooker configured to simply achieve supply of water into a steam generating unit equipped therein.

In accordance with an exemplary embodiment of the present invention, a heating cooker comprises a cabinet defined therein with a cooking chamber.A steam generating unit supplies steam into the cooking chamber, and comprises a heating tank detachably mounted to the top of the cooking chamber inside the cooking chamber. It also includes steam outlet ports, a water tank connected to the heating tank via a guide passage to supply water into the heating tank, and a steam generating heater installed in the heating tank to heat water contained in the heating tank.

The water tank may be mounted to the top of the cooking chamber so that the supply of water from the water tank into the heating tank is naturally carried out.

The heating cooker may further comprise an outlet opening/closing unit installed at an outlet of the water tank to control the supply of water from the water tank into the heating tank.

The outlet opening/closing unit may include an opening/closing member arranged to be rearwardly extendable into and forwardly retractable from the outlet of the water tank by a predetermined distance, and adapted to close and open the outlet, a packing fitted around a periphery of the opening/closing member, and adapted to maintain the outlet in a sealed state, an elastic member for elastically supporting the opening/closing member to normally maintain the opening/closing member in a closing state, and a solenoid actuating unit for retracting the opening/closing member against an elasticity of the elastic member to open the outlet.

The heating cooker may further comprise a water level sensing unit installed in the heating tank, and adapted to sense a water level in the heating tank, thereby controlling an operation of the outlet opening/closing unit so that the water level in the heating tank is maintained to be lower than a level of the steam outlet holes.

The heating cooker may further comprise a water level sensing unit installed in the heating tank, and adapted to sense a water level in the heating tank, thereby controlling an operation of the solenoid actuating unit so that the water level in the heating tank is maintained to be lower than a level of the steam outlet holes.

The heating cooker may further comprise an overheat sensor installed in the heating tank, and adapted to sense an overheated state of the heating tank, thereby controlling the steam generating heater.

The heating tank may have a container structure opened at an upper end thereof. The opened upper end of the heating tank may be sealably coupled to the top of the cooking chamber outside the cooking chamber in a state in which a packing is interposed between the opened upper end of the heating tank and the top of the cooking chamber. The steam outlet holes may be arranged at a plurality of positions on opposite side walls of the heating tank near the upper end of the heating tank, respectively.

The steam generating heater may be mounted to the top of the cooking chamber such that a large part thereof is dipped in water in the heating tank.

The heating tank may be provided with steam guide members respectively connected to the steam outlet holes. Each steam guide member may define a flow guide passage for downwardly guiding steam discharged from the heating tank through an associated one of the steam outlet holes into the cooking chamber, and have an outlet downwardly directed.

The heating tank may be provided, at opposite sides of an upper end thereof, with fixing portions each formed with a coupling hole, respectively, and adapted to fix the heating tank to the top of the cooking chamber. Coupling members may be threadedly coupled to the top of the cooking chamber through respective coupling holes of the fixing portions inside the cooking chamber.

Each coupling member may have a threaded portion adapted to be threadedly coupled to the top of the cooking chamber through the associated coupling hole, and a knob portion integral with the threaded portion, the knob portion allowing a user to fasten or loosen the threaded portion by hand.

The cabinet may include an outer case, and an inner case arranged in the outer case while being spaced apart from the outer case. The inner case may define the heating chamber therein. The water tank and outlet opening/closing unit may be installed in a space defined between the outer and inner cases.

The water tank may be detachably mounted through an opening formed at a front wall of the cabinet.

The heating cooker may further comprise a recess rearwardly recessed from a rear surface of the cooking chamber to a desired depth, a blowing fan installed in the recess, and adapted to circulate air existing in the cooking chamber, and a heater arranged around the blowing fan, and adapted to heat the air circulating through the blowing fan.

The heating cooker may further comprise a cover arranged in front of the recess to cover the recess, the cover having a plurality of through holes.

In accordance with another exemplary embodiment of the present invention, a heating cooker comprises a cabinet defined therein with a cooking chamber; and a steam generating unit for supplying steam into the cooking chamber. The steam generating unit includes a heating tank mounted to the top of the cooking chamber inside the cooking chamber, and provided with steam outlet ports, a water tank detachably mounted to the cabinet over the cooking chamber, and adapted to supply water into the heating tank, a steam generating heater adapted to heat water contained in the heating tank, and a flow guide passage adapted to guide the supply of water from the water tank into the heating tank.

BRIEF DESCRIPTION OF THE DRAWINGS

The above and other features and advantages of the present invention will become more apparent by describing in detail exemplary embodiments thereof with reference to the attached drawings, in which.

DETAILED DESCRIPTION OF ILLUSTRATIVE, NON-LIMITING EMBODIMENTS OF THE INVENTION

The present invention will now be described more fully with reference to the annexed drawings, in which illustrative, non-limiting embodiments of the invention are shown.

Figure 1:
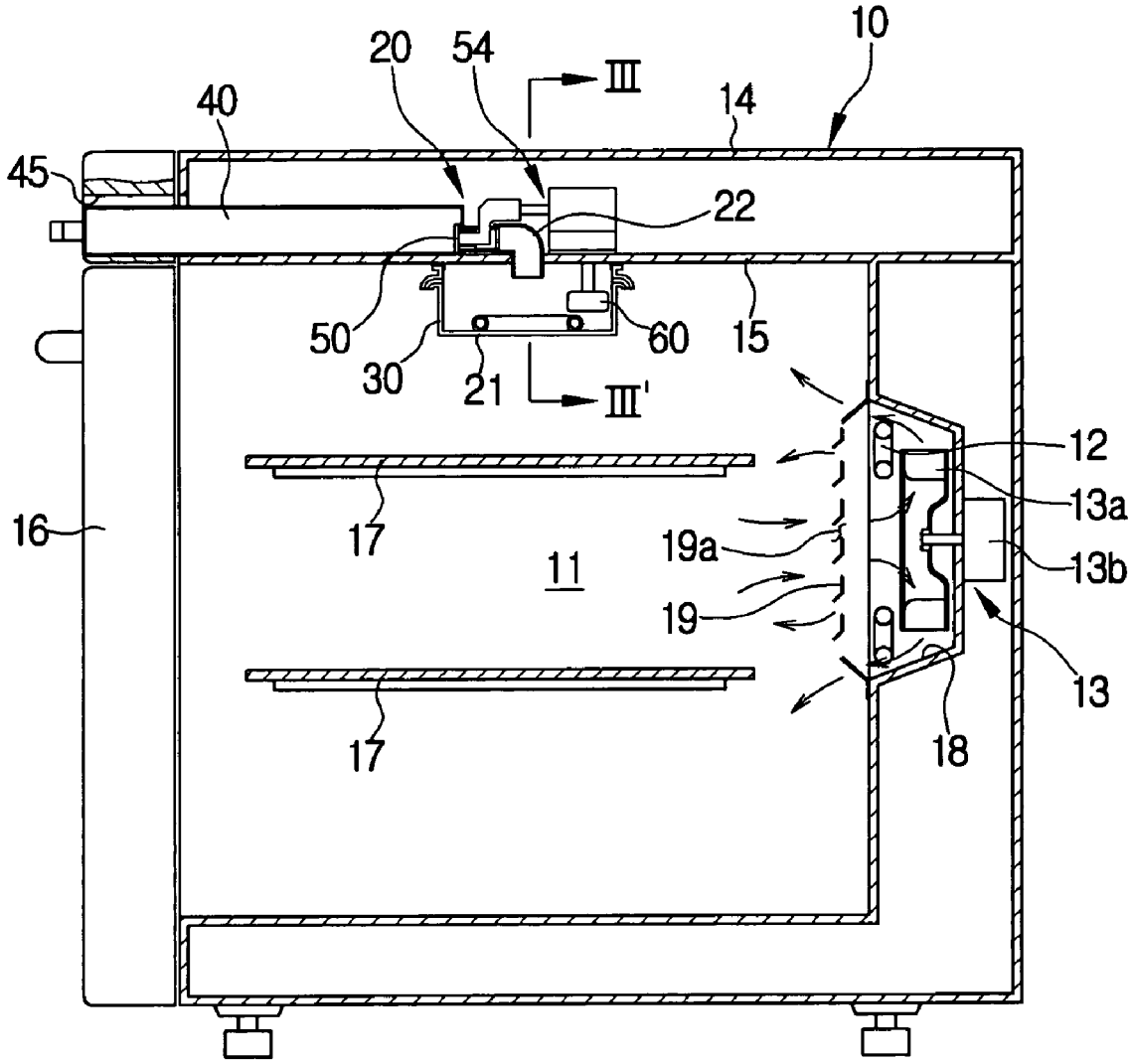
FIG. 1 is a sectional view illustrating the overall configuration of a heating cooker according to an embodiment of the present invention.

Referring to FIG. 1, a heating cooker according to an exemplary embodiment of the present invention is illustrated. As shown in FIG. 1, this heating cooker includes a cabinet 10 defined therein with a cooking chamber 11, a heater 12 installed at a rear surface of the cooking chamber 11 to heat the interior of the cooking chamber 11, and a blowing unit 13 for circulating air in the cooking chamber 11. The heating cooker also includes a steam generating unit 20 for supplying steam into the cooking chamber 11.

The cabinet 10 includes an outer case 14 made of a metal plate, and an inner case 15 arranged in the outer case 14 while being spaced apart from the outer case 14. The inner case 15 defines the cooking chamber 11 therein. The cooking chamber 11 is forwardly opened to allow food to be introduced into or taken out of the cooking chamber 11. A door 16 is mounted to a front wall of the cabinet 10 such that it opens and closes the cooking chamber 11 in accordance with door opening and closing operations of the user. Lathes 17 are mounted in the cooking chamber 11 such that they are vertically arranged, in order to support food laid thereon.

The cooking chamber 11 is provided, at its rear surface, with a recess 18 rearwardly recessed from the rear surface to a desired depth. In the recess 18, the heater 12 and blowing unit 13 are installed. The blowing unit 13 includes a centrifugal blowing fan 13*a* rotatably mounted to a central portion of the recess 18 inside the recess 19, and a drive motor 13*b* installed in rear of the recess 18, and adapted to rotate the blowing fan 13*a*. The heater 12 is installed in the recess 18 such that it is arranged around the blowing fan 13*a*. In front of the recess 18, a cover 19 having a plurality of through holes 19*a* is mounted to the rear surface of the cooking chamber 11 to cover the recess 18. In accordance with this configuration, when the blowing fan 13*a* operates in an operating state of the heater 12, air existing in the cooking chamber 11 is sucked toward the blowing fan 13*a*, and then radially outwardly discharged from the blowing fan 13*a* while being heated by the heater 12, so that the air is again supplied into the cooking chamber 11 in a heated state. Through such a hot air circulation, the cooking chamber 11 is heated, thereby causing the food received therein to be cooked.

Figure 2:
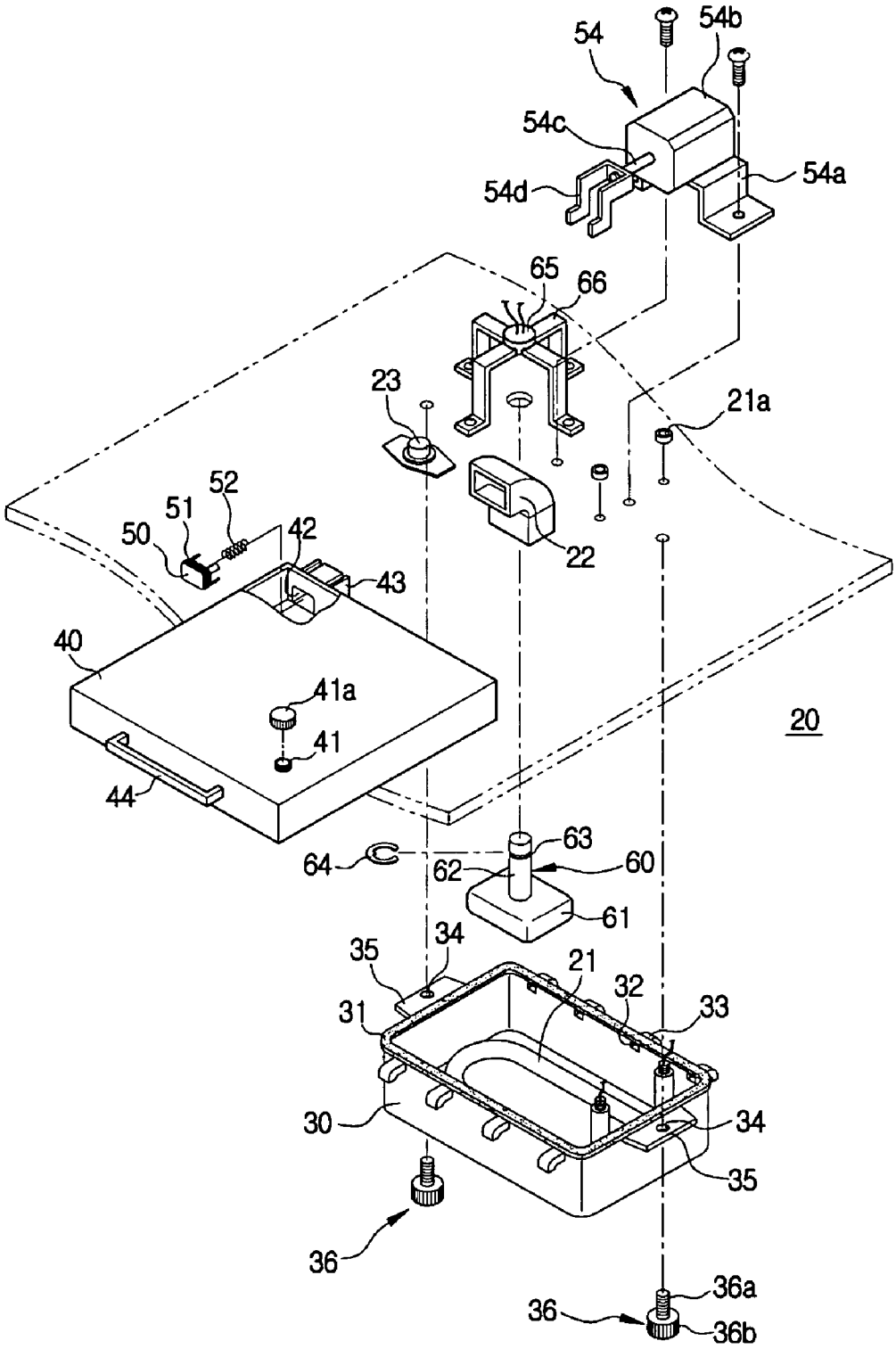
FIG. 2 is an exploded perspective view illustrating the configuration of a steam generating unit included in the heating cooker.

As shown in FIGS. 1 and 2, the steam generating unit 20 adapted to supply steam into the cooking chamber 11 includes a heating tank 30 detachably mounted to the top of the cooking chamber 11 inside the cooking chamber 11, a steam generating heater 21 for heating water supplied into the heating tank 30, and a water tank 40 mounted to the top of the cooking chamber 11 outside the cooking chamber 11, and adapted to supply water into the heating tank 30. The steam generating unit 20 also includes a connecting pipe 22 for defining a flow guide passage to guide the supply of water from the water tank 40 into the heating tank 30, an outlet opening/closing unit installed at an outlet 42 of the water tank 40 to control the supply of water into the heating tank 30, a water level sensing unit 60 for sensing the water level in the heating tank 30, and an overheat sensor for sensing an overheated state of the heating tank 30.

Figure 3:
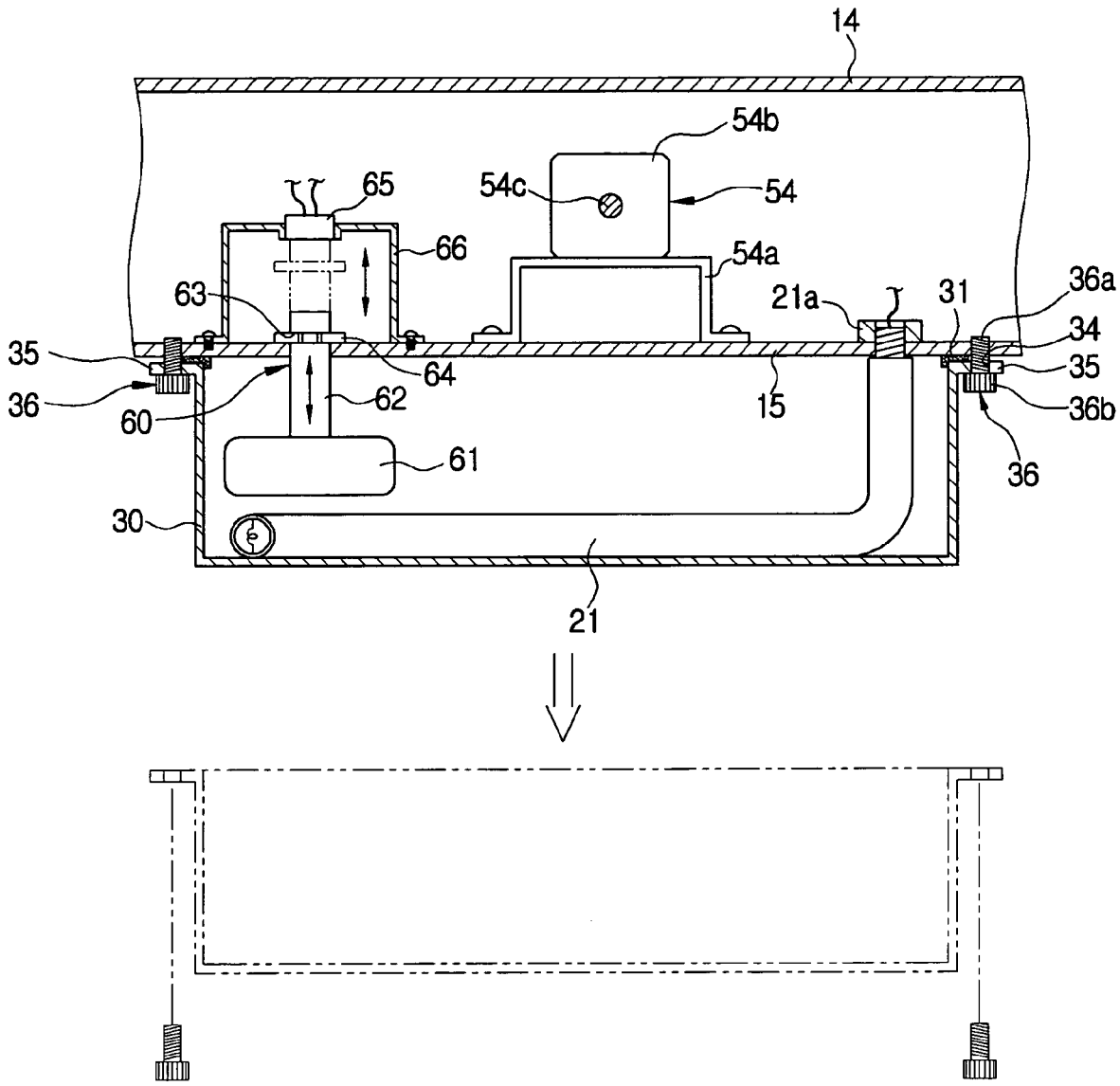
FIG. 3 is a cross-sectional view taken along the line III—III in FIG. 3.
Figure 4:
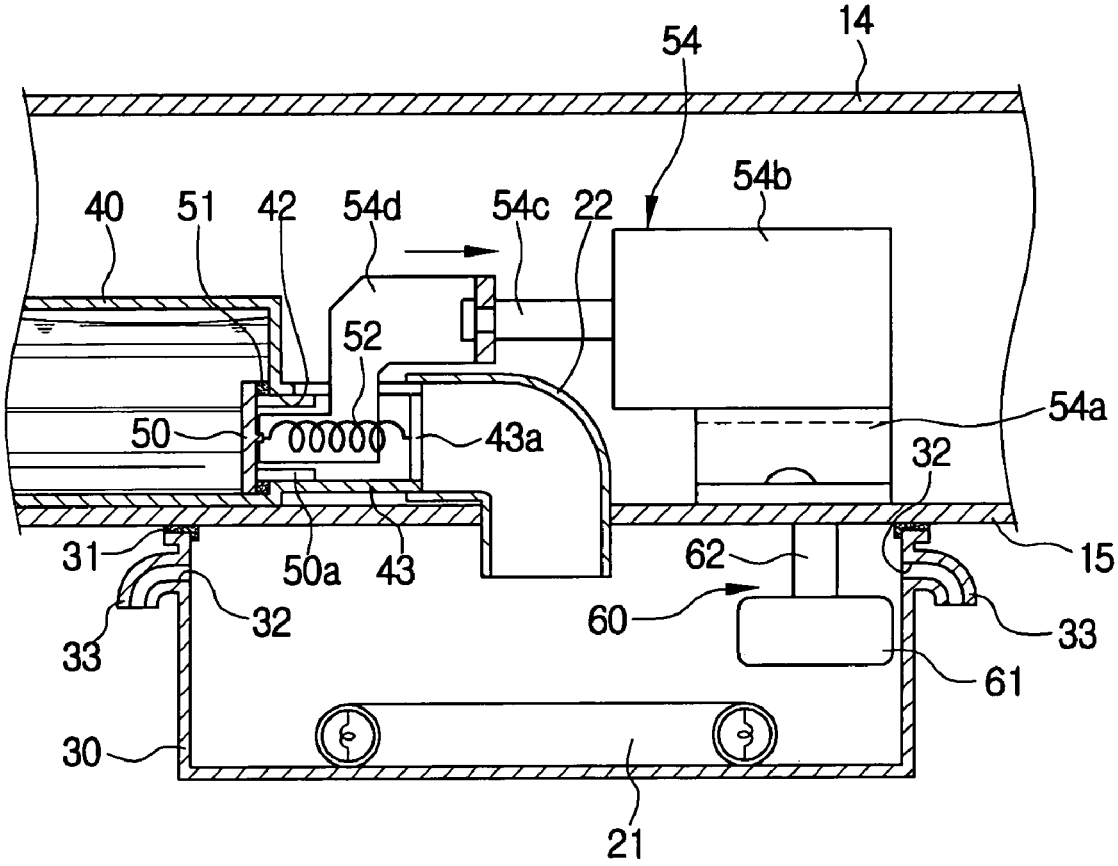
FIG. 4 is a sectional view of the steam generating unit, illustrating a closed state of its water tank at an outlet thereof.

As shown in FIGS. 2 to 4, the heating tank 30 has a container structure opened at an upper end thereof. The opened upper end of the heating tank 30 is sealably coupled to the top of the cooking chamber 11 outside the cooking chamber 11 in a state in which a packing 31 is interposed between the opened upper end of the heating tank 30 and the top of the cooking chamber 11. A plurality of uniformly spaced steam outlet holes 32 are formed at opposite side walls of the heating tank 30 near the upper end of the heating tank 30 in order to supply steam generated in the heating tank 30 into the cooking chamber 11. A steam guide member 33, which communicates with each steam outlet hole 32 at an outlet thereof, is mounted to an associated side wall of the heating tank 30. The steam guide member 33 extends downwardly to define a flow passage for downwardly guiding steam from the heating tank 30 into the cooking chamber 11, while having an outlet directed downwardly. The heating tank 30 is provided, at opposite sides of an upper end thereof, with fixing portions 35 each formed with a coupling hole 34, respectively. Coupling members 36 are threadedly coupled to the top of the cooking chamber 11 through respective coupling holes 34 of the fixing portions 35 in order to fix the heating tank 30 to the top of the cooking chamber 11. Each coupling member 36 has a threaded portion 36*a* adapted to be threadedly coupled to the top of the cooking chamber 11 through the associated coupling hole 34, and a knob portion 36*b* integral with the threaded portion 36*a*. The knob portion 36*b* allows the user to fasten or loosen the threaded portion 36*a* by hand. With this configuration, the user can simply carry out mounting and separation of the heating tank 30 by fastening or loosening the coupling members 36 by hand, and thus, can easily clean the interior of the heating tank 30.

As shown in FIGS. 2 and 3, the steam generating heater 21 installed in the heating tank 30 is arranged to be dipped in water contained in the heating tank 30 at a large part thereof. The steam generating heater 21 has terminal portions electrically connected to an electric power source, and respectively fixed to the top of the cooking chamber 11 by means of fixing nuts 21*a*. With this configuration, the steam generating heater 21 is exposed in a state of being fixed to the top of the cooking chamber 11 when the heating tank 30 is separated from the top of the cooking chamber 11 for cleaning. Accordingly, it is possible to easily remove foreign matter attached to the surface of the steam generating heater 21.

As shown in FIG. 1, the water tank 40 is installed in a space defined between the outer and inner cases 14 and 15 over the cooking chamber 11. The water tank 40 is detachably mounted to the cabinet 40 in such a fashion that it can be forwardly removed from the cabinet 40 through an opening 45 formed at an upper portion of the front wall of the cabinet 10. As shown in FIG. 2, the water tank 40 includes a tank body having a box shaped container structure, an inlet 41 formed at an upper wall of the tank body while being opened or closed by a plug 41*a*, an outlet 42 formed at a rear wall of the tank body, and adapted to supply water from the water tank 40 into the heating tank 30, and a handle 44 provided at a front wall of the tank body. Preferably, the tank body of the water tank 40 is transparent in order to allow the user to easily identify the water level in the water tank 40. The outlet 42 of the water tank 40 is separably connected to the connecting pipe 22 such that it communicates with the heating tank 30. The connecting pipe 22 is mounted to the top of the cooking chamber 11 while extending through the top of the cooking chamber into the heating tank 30. An extension 43 is connected to the outlet 42 of the water tank 40 while extending from the outlet of the connecting pipe 22 to a desired length. The extension 43 is coupled to the connecting pipe 22 in such a fashion that it is fitted in an inlet of the connecting pipe 22.

As shown in FIGS. 2 and 4, the outlet opening/closing unit adapted to open and close the outlet 42 of the water tank 40 includes an opening/closing member 50 installed at the outlet 42 of the water tank 40 inside the water tank such that it is rearwardly extendable into and forwardly retractable from the outlet 42, in order to close and open the outlet 42. The outlet opening/closing unit also includes a packing 51 fitted around the periphery of the opening/closing member 50, and adapted to maintain the outlet 42 in a sealed state, an elastic member 52 for elastically supporting the opening/closing member 50 to normally maintain it in a closing state, and a solenoid actuating unit 54 for retracting the opening/closing member 50 against the elasticity of the elastic member 52 by a predetermined distance to open the outlet 42.

The opening/closing member 50 has a plurality of guide portions 50*a* extending rearwardly from a rear surface of the opening/closing member 50 into the outlet 42. The opening/closing member 50 is supported by the guide portions 50*a* such that it is rearwardly extendable into and forwardly retractable from the outlet 42. The elastic member 52 comprises a well-known tension coil spring. The elastic member 52 is connected, at one end thereof, to the opening/closing member 50 while being connected, at the other end thereof, to a support portion 43*a* provided at a free end of the extension 43. With this configuration, the opening member 50 is normally maintained in a state of closing the outlet 42 by virtue of the elasticity of the elastic member 52.

Figure 5:
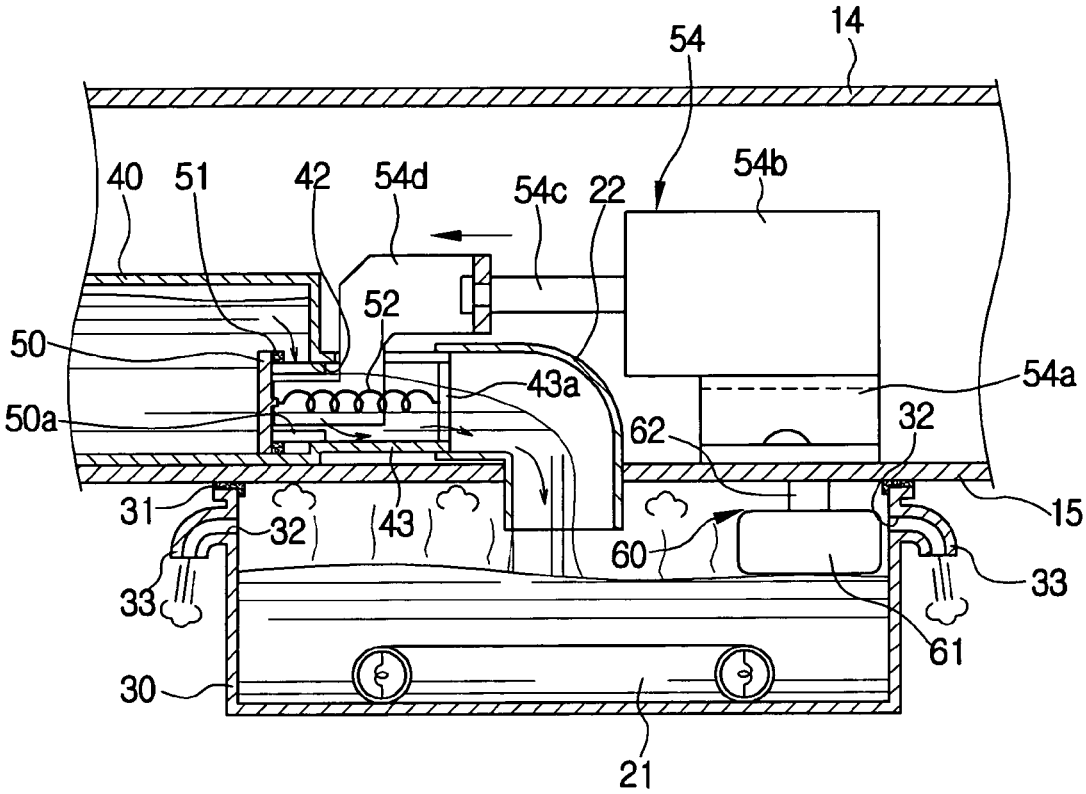
FIG. 5 is a sectional view of the steam generating unit, illustrating an opened state of the water tank at its outlet and a steam generating operation of the steam generating unit.

The solenoid actuating unit 54 is installed between the outer and inner cases 14 and 15 in rear of the outlet 42 of the water tank 40. The solenoid actuating unit 54 includes a solenoid actuator 54*b* fixed to the top of the cooking chamber 11 outside the cooking chamber 11 by means of a bracket 54*a*, a rod 54*c* extending forwardly from the solenoid actuator 54*b* toward the outlet 42 of the water tank 40, and a push member 54*d* connected to a front end of the rod 54*c*, and adapted to push the opening/closing member 50 in accordance with forward extension of the rod 54*c*, thereby opening the outlet 42 of the water tank 40. The push member 54*d* extends forwardly from the front end of the rod 54*c*, and is then downwardly bent to extend into the extension 43 through an opening formed at the top of the extension 43 provided at the outlet 42. Thereafter, the push member 54*d* again extends forwardly toward the rear surface of the opening/closing member 50 so that it can push the rear surface of the opening/closing member 50. With this configuration, when the solenoid actuator 54*b* is switched from its active state to its inactive state, the opening/closing member 50 is rearwardly moved by virtue of the elasticity of the elastic member 52, thereby closing the outlet 42 of the water tank 40, as shown in FIG. 4. At this time, the push member 54*d* is also rearwardly moved in accordance with the rearward movement of the opening/closing member 50. On the other hand, when the solenoid actuator 54*b* is activated, the push member 54*d* is forwardly moved, so that the opening/closing member 50 is forwardly pushed by the push member 54*d*, thereby opening the outlet 42 of the water tank 40, as shown in FIG. 5.

As shown in FIGS. 2 and 3, the water level sensing unit 60 adapted to sense the water level in the heating tank 30 includes a float member 61 installed in the heating tank 30, and made of a material buoyant in water, a rod 62 extending upwardly from the top of the float member 61 through the top of the cooking chamber 11 such that it is vertically moved along with the float member 61, and a sensor 65 mounted on the top of the cooking chamber 11 outside the cooking chamber 11 at a position corresponding to the rod 62 by means of a support member 66. An annular groove 63 is formed at the outer peripheral surface of a portion of the rod 62 extending upwardly beyond the top of the cooking chamber 11. A snap ring 64 is fitted around the groove 63 in order to limit a downward movement of the rod member 62. In accordance with this configuration of the water level sensing unit 60, the rod 62 is upwardly moved as the float member 61 is raised in accordance with an increase in the water level in the heating tank 30. When the upper end of the rod member 62 comes into contact with the sensor 65 in accordance with the upward movement of the rod 62, the sensor 65 senses an upper limit of the water level in the heating tank 30. Based on such water level sensing information, the solenoid actuating unit 54 is controlled by a control unit (not shown) included in the heating cooker such that the water level in the heating tank 30 is maintained to be lower than the upper limit, for example, the level of the steam outlet holes 32. Accordingly, it is possible to prevent water in the heating tank 30 from overflowing through the steam outlet holes 32.

The overheat sensor 23 is mounted to the outer upper surface of the cooking chamber 11 over the heating tank 30, as shown in FIG. 2. The overheat sensor 23 senses an overheated state of the heating tank 30, thereby controlling the steam generating heater 21. Accordingly, it is possible to prevent the steam generating heater 21 from operating under the condition in which there is no water in the heating tank 30.

The overall operation of the heating cooker having the above described configuration and a method for cleaning the heating tank and steam generating heater will be described.

When the heating cooker operates under the condition in which food to be cooked is laid on the lathes 17 in the cooking chamber 11, the heater 12 and blowing fan 13*a* are operated. In accordance with the operation of the blowing fan 13*a*, air existing in the cooking chamber 11 is sucked toward the central portion of the blowing fan 13*a*, and is then radially outwardly discharged from the blowing fan 13*a*. The air discharged from the blowing fan 13*a* is supplied into the cooking chamber 11 after being heated while passing through the heater 12. Thus, the food in the cooking chamber 11 is cooked.

When the user desires to cook the food under the condition in which steam is supplied into the cooking chamber 11, he first separates the water tank 40 mounted over the cooking chamber 11 by forwardly ejecting the water tank 40, and then fills water in the water tank 40. Thereafter, the user inserts the water-filled water tank 40 into the opening 45 at the upper portion of the cabinet 10 so that the water tank 40 is again mounted over the cooking chamber 11. At this time, the outlet 42 of the water tank 40 is maintained in a closed state because the opening/closing member 50 is in contact with the outlet 42 by virtue of the elastic member 52. Accordingly, there is no leakage of water through the outlet 42 in the process of mounting and separating the water tank 40.

After completion of the mounting of the water-filled water tank 40, the steam generating unit 20 is operated in accordance with operation of the user for activating associated elements. That is, as shown in FIG. 5, the solenoid actuating unit 54 is activated to push the opening/closing member 50, thereby opening the outlet 42 of the water tank 40. In this state, the water in the water tank 40 is supplied into the heating tank 40 through the connecting pipe 22. When the water level in the heating tank 40 is increased to a predetermined level in accordance with the supply of water, the water level sensing unit 60 senses this water level. Based on such water level sensing information, the control unit (not shown) of the heating cooker controls the operation of the solenoid actuating unit 54 to close and open the outlet 42 of the water tank 40. Accordingly, the water level in the heating tank 30 is appropriately maintained. That is, the water level in the heating tank 30 is maintained to be lower than the level of the steam outlet holes 32.

When the steam generating heater 21 is operated, simultaneously with the above operation, the water received in the heating tank 30 is heated by the steam generating heater 21, so that steam is generated in the heating tank 30. The steam is subsequently supplied into the cooking chamber 11 through the steam outlet holes 32 provided at the side walls of the heating tank 30 near the upper end of the heating tank 30. The steam in the cooking chamber 11 is guided toward the food positioned at a lower portion of the cooking chamber 11, along the steam guide members 33. As a result, it is possible to prevent the food from being dried while achieving an enhancement in cooking effects.

Meanwhile, when the user desires to clean the interior of the heating tank 30 and the steam generating heater 21, he first loosens the coupling members 36, thereby separating the heating tank 30 from the cooking chamber 11. In this state, the user can simply clean the interior of the heating tank 30. Since the knob portion 36*b* of each coupling member 36 is in an exposed state in the cooking chamber 11, the operation of loosening the coupling member 36 can be easily carried out. In the separated state of the heating tank 30, the steam generating heater 21 mounted to the top of the cooking chamber 11 is exposed. Accordingly, the user can easily remove foreign matter attached to the surface of the steam generating heater 21.

As apparent from the above description, the heating cooker according to the present invention provides an effect capable of easily cleaning the heating tank and steam generating heater of the steam generating unit because the user can simply separate the heating tank from the cooking chamber, and the steam generating heater is exposed in accordance with the separation of the heating tank.

Since the heating tank is arranged at the top of the cooking chamber, it is possible to prevent solids of food or oil from being introduced into the heating tank during the process of cooking the food. Accordingly, the sanitary management of the heating cooker can be easily achieved.

In addition, the supply of water into the steam generating unit can be easily achieved because the water tank can be separated, and thus, the user can sufficiently fill water in the water tank in the separated state thereof.

Although exemplary embodiments of the invention have been disclosed for illustrative purposes, those skilled in the art will appreciate that various modifications, additions and substitutions are, possible, without departing from the scope and spirit of the invention as disclosed in the accompanying claims.

What is claimed is:

1. A heating cooker comprising:

a cabinet defined therein with a cooking chamber; and a steam generating unit for supplying steam into the cooking chamber, the steam generating unit comprising a heating tank detachably mounted to the top of the cooking chamber inside the cooking chamber, and provided with steam outlet holes, a water tank connected to the heating tank via a guide passage to supply water into the heating tank, and a steam generating heater installed in the heating tank to heat water contained in the heating tank.

2. The heating cooker according to claim 1, wherein the water tank is mounted to the top of the cooking chamber so that the supply of water automatically flows from the water tank into the heating tank.

3. The heating cooker according to claim 2, further comprising:

an outlet opening/closing unit installed at an outlet of the water tank to control the supply of water from the water tank into the heating tank.

4. The heating cooker according to claim 3, wherein the outlet opening/closing unit comprises:

an opening/closing member arranged to be rearwardly extendable into and forwardly retractable from the outlet of the water tank by a predetermined distance, and adapted to close and open the outlet;

a packing fitted around a periphery of the opening/closing member, and adapted to maintain the outlet in a sealed state;

an elastic member for elastically supporting the opening/closing member to normally maintain the opening/closing member in a closing state; and a solenoid actuating unit for retracting the opening/closing member against an elasticity of the elastic member to open the outlet.

5. The heating cooker according to claim 3, further comprising:

a water level sensing unit installed in the heating tank, and adapted to sense a water level in the heating tank, thereby controlling an operation of the outlet opening/closing unit so that the water level in the heating tank is maintained to be lower than a level of the steam outlet holes.

6. The heating cooker according to claim 4, further comprising:

a water level sensing unit installed in the heating tank, and adapted to sense a water level in the heating tank, thereby controlling an operation of the solenoid actuating unit so that the water level in the heating tank is maintained to be lower than a level of the steam outlet holes.

7. The heating cooker according to claim 1, further comprising:

an overheat sensor installed in the heating tank, and adapted to sense an overheated state of the heating tank, thereby controlling the steam generating heater.

8. The heating cooker according to claim 1, wherein:

the heating tank has a container structure opened at an upper end thereof;

the opened upper end of the heating tank is sealably coupled to the top of the cooking chamber in a state in which a packing is interposed between the opened upper end of the heating tank and the top of the cooking chamber; and the steam outlet holes are arranged at a plurality of positions on opposite side walls of the heating tank near the upper end of the heating tank, respectively.

9. The heating cooker according to claim 8, wherein the steam generating heater is mounted to the top of the cooking chamber such that a large part thereof is dipped in water in the heating tank.

10. The heating cooker according to claim 8, wherein the heating tank is provided with steam guide members respectively connected to the steam outlet holes, each of the steam guide members defining a flow guide passage for downwardly guiding steam discharged from the heating tank through an associated one of the steam outlet holes into the cooking chamber, and having an outlet downwardly directed.

11. The heating cooker according to claim 1, wherein:

the heating tank is provided, at opposite sides of an upper end thereof, with fixing portions each formed with a coupling hole, respectively, and adapted to fix the heating tank to the top of the cooking chamber; and coupling members are threadedly coupled to the top of the cooking chamber through respective coupling holes of the fixing portions inside the cooking chamber.

12. The heating cooker according to claim 11, wherein each of the coupling members has a threaded portion adapted to be threadedly coupled to the top of the cooking chamber through the associated coupling hole, and a knob portion integral with the threaded portion, the knob portion allowing a user to fasten or loosen the threaded portion by hand.

13. The heating cooker according to claim 3, wherein:

the cabinet includes an outer case, and an inner case arranged in the outer case while being spaced apart from the outer case, the inner case defining the heating chamber therein; and the water tank and the outlet opening/closing unit are installed in a space defined between the outer and inner cases.

14. The heating cooker according to claim 13, wherein the water tank is detachably mounted through an opening formed at a front wall of the cabinet.

15. The heating cooker according to claim 1, further comprising:

a recess rearwardly recessed from a rear surface of the cooking chamber to a desired depth;

a blowing fan installed in the recess, and adapted to circulate air existing in the cooking chamber; and a heater arranged around the blowing fan, and adapted to heat the air circulating through the blowing fan.

16. The heating cooker according to claim 15, further comprising:

a cover arranged in front of the recess to cover the recess, the cover having a plurality of through holes.

17. A heating cooker comprising:

a cabinet defined therein with a cooking chamber; and a steam generating unit for supplying steam into the cooking chamber, the steam generating unit including a heating tank mounted to the top of the cooking chamber inside the cooking chamber, a water tank detachably mounted to the cabinet over the cooking chamber, and adapted to supply water into the heating tank, a steam generating heater adapted to heat water contained in the heating tank, and a flow guide passage adapted to guide the supply of water from the water tank into the heating tank.

18. The heating cooker according to claim 17, wherein the heating tank comprises steam outlet ports adapted to supply steam from the heating tank into the cooking chamber.

* * * * *